United States Patent [19]

Seaton

[11] 4,044,927

[45] Aug. 30, 1977

[54] LADLE WITH AXIS OF ROTATION THROUGH DISCHARGE SPOUT

[75] Inventor: William Wayne Seaton, Dexter, Mich.

[73] Assignee: Combustion Engineering, Inc., Windsor, Conn.

[21] Appl. No.: 730,405

[22] Filed: Oct. 7, 1976

[51] Int. Cl.[2] ..... B22D 37/00

[52] U.S. Cl. ..... 222/604; 164/337; 222/166

[58] Field of Search ..... 164/335, 336; 222/166, 222/167, 590, 604, 572

[56] References Cited

U.S. PATENT DOCUMENTS

| | | | |
|---|---|---|---|
| 3,940,021 | 2/1976 | Sillen et al. | 222/604 |
| 3,977,460 | 8/1976 | Badone et al. | 222/166 X |

FOREIGN PATENT DOCUMENTS

| | | | |
|---|---|---|---|
| 1,243,338 | 7/1964 | Germany | 222/604 |

*Primary Examiner*—Robert B. Reeves

*Assistant Examiner*—David A. Scherbel

*Attorney, Agent, or Firm*—Robert L. Olson

[57] ABSTRACT

A pouring ladle for pouring molten metal into molds or other containers, including wall structure forming a chamber for holding the molten metal, a spout having wall structure forming longitudinal passage means therein, the passage having an inlet end in fluid communication with a chamber and an outlet end through which molten metal can be discharged, a drive gear arrangement is provided for rotating the pouring ladle about an axis of rotation, positioned such that the axis of rotation passes through the center of the discharge end of the passage, and the pouring ladle and spout being constructed such that the lower outer surface of the wall structure forming the chamber and the lower outer surface of the wall structure of the spout lie in the same horizontal plane when the ladle is in its full, non-pouring position. Thus, the entire ladle can be positioned above the mold while it is being filled with molten metal, or while the ladle is being moved to the pouring position.

6 Claims, 5 Drawing Figures

LADLE WITH AXIS OF ROTATION THROUGH DISCHARGE SPOUT

BACKGROUND OF THE INVENTION

In recent times, much has been accomplished in automating foundries so that both the quantity and quality of castings has been enhanced. Molds are produced in assembly line fashion, at a high rate of production. The equipment for pouring molten metal into these molds has likewise been automated and improved along with the mold making machinery. A typical foundry metal pouring system will consist of a stationary bottom pouring stopper holding ladle which is used to fill one or more pouring ladles which shuttle back and forth on a track between the holding ladle and the molds. Some molds are quite large today, being on the order of 6 feet square, and require hundreds of pounds of molten metal for a single casting. This large mold size presents some problems, in pouring with conventional ladles, such as molten metal spillage, and premature chilling of the molten metal. Known ladle tilting pouring systems require either a connecting channel, or a long spout on the ladle to pour metal into the centrally located pouring basin. The long spout will chill the metal and become built up with an accumulation of solidified metal and dross.

SUMMARY OF THE INVENTION

The pouring ladle of the invention includes a holding chamber or pot, a short spout having a longitudinal passage therein extending from the chamber, with the axis of rotation of the ladle coinciding with the axis of the passage in the spout. The axis of rotation of the ladle lies at an angle to the horizontal, and the lower outer surface of the walls of the chamber is at the same vertical height as the lower outer surface of the wall means of the spout. The above permits the entire ladle to be swung out over the upper surface of a mold with the distance end of the spout in close juxtaposition to the upper mold surface, so that the mold can be easily filled regardless of where the sprue opening is located, with minimal spillage or molten metal chilling.

DESCRIPTION OF THE PREFERRED EMBODIMENT

Figure 1:
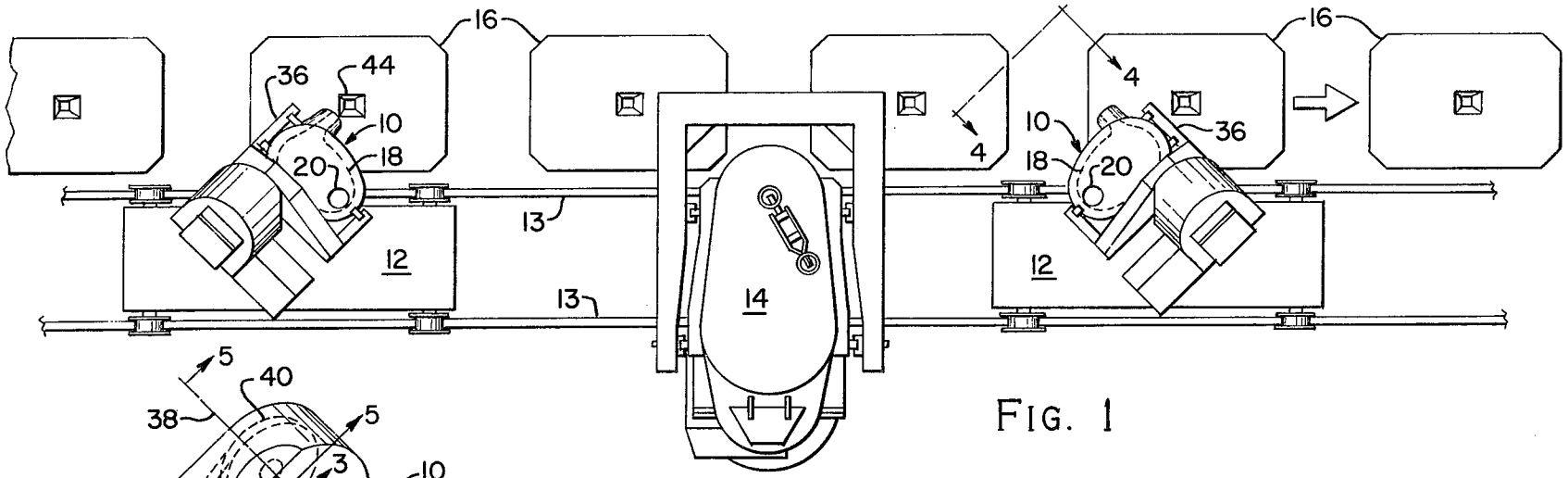
FIG. 1 is a plan view of a foundry metal pouring system.

Looking now to FIG. 1 of the drawings, a pair of pouring ladles 10 are shown mounted on cars 12 so they can shuttle back and forth on tracks 13 between a bottom pouring stopper holding ladle 14, and a conveyor line of moving molds 16. The pouring ladles 10 are sized to hold a sufficient amount of metal to fill one mold 16. The holding ladle 14 is suspended above the elevation of the pouring ladles and alternately replenishes the two ladles through ladle openings 20; i.e., when one ladle is making a pour into a mold 16, the other is being filled by the holding ladle, and vice versa. Molten metal is gravity discharged through a bottom opening (not shown) in the holding ladle 14, into the chamber 18 in the pouring ladle 10, through an upper opening 20. The controls for the pouring ladles 10 and the cars they are mounted on can be designed such that the molds 16 can be poured while they are moving, if desired, as set forth in copending Patent Application Ser. No. 614,088 filed on Sept. 17, 1975. This forms no part of the present invention, and will not be described in any further detail.

Figure 3:
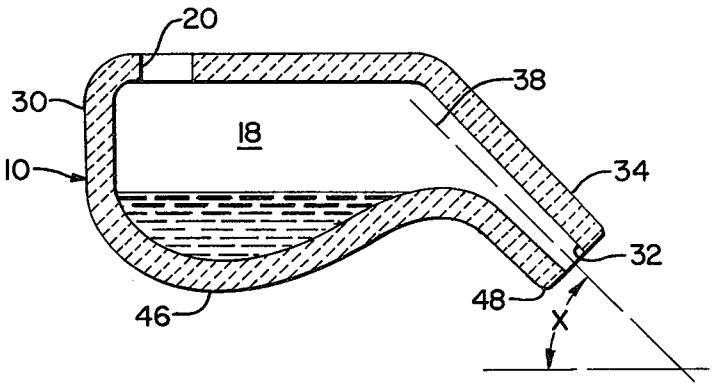
FIG. 3 is a sectional view taken on line 3—3 of FIG. 2
Figure 2:
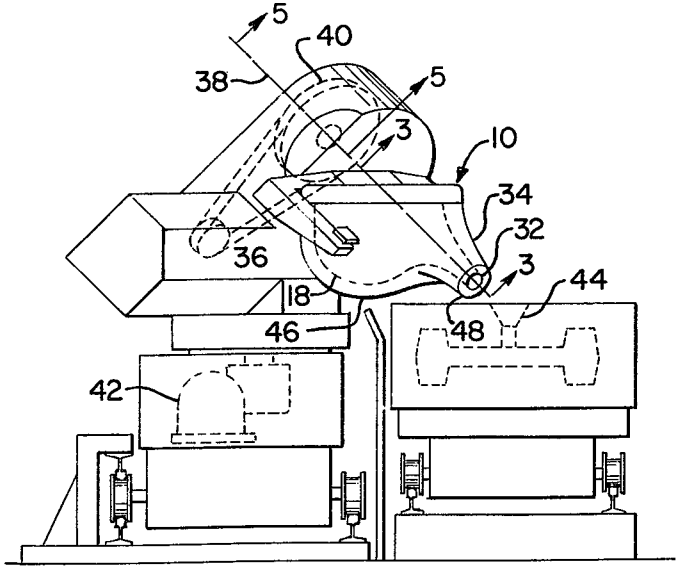
FIG. 2 is a side view of one of the pouring ladles shown in FIG. 1.
Figure 4:
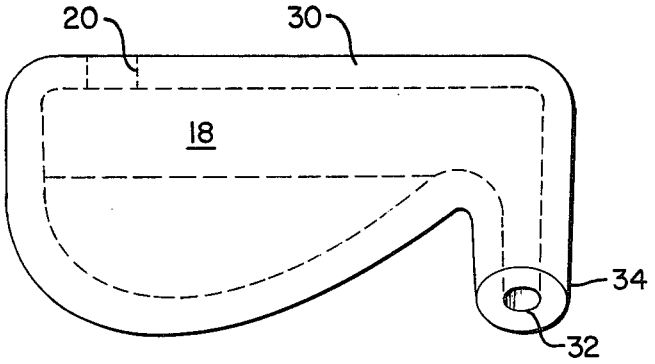
FIG. 4 is a sectional view taken on line 4—4 of FIG. 1.

Looking now to FIGS. 2, 3 and 4, the construction of one of the pouring ladles 10 is shown in more detail. The ladle has a chamber 18 which is completely enclosed by insulating walls 30, with the exceptions of upper opening 20, and the passagway 32 in spout 34. The ladle is fixedly mounted in yoke 36, in such a manner that the yoke and ladle can be rotated about the axis 38 by means of drive 40. The entire chamber 18 lies to one side of the pouring spout 34. There is an optimal alignment of the axis of the spout and that of the tilt basin; i.e., the axis of rotation 38 coincides with the longitudinal axis of passageway 32 in the spout 34. Thus, the discharge end of the spout does not change its location relative to the mold during a pour. The pouring ladle 10 and its associated cradle arrangement is also rotatable about a vertical axis by means of a drive gear arrangement 42, shown in dashed lines in FIG. 2. This permits the ladle to be rotated so as to be properly aligned with the discharge opening in the holding ladle when being filled, and rotated out over the upper surface of the mold so that the pouring spout can be accurately positioned with respect to the sprue opening 44 of the mold during a pour, regardless of where on the upper surface of the mold the opening 44 is located. It also permits the ladle to be rotated 180° so that an operator can occasionally clean the lip of the spout, or exchange ladles when necessary. The rotating feature could also be used for pouring different molds, having different sprue opening locations. For example, alternate or every third mold could be different, and the control could be programmed so that the unit would automatically operate in this manner.

The lower outer surface 46 of the wall of the chamber 18 lies in the same plane as the lower outer surface 48 of the wall of the spout 34, so that the entire pouring ladle can be swung out over the mold, while maintaining the spout end in close proximity to the upper surface of the mold so that little spillage occurs during a pour, with the passageway 32 remaining in a fixed position during the entire pour. The pouring spout is fairly short in length, so that the molten metal is not chilled to a great extent in passing through passageway 32 during a pour. Also, since the spout lies at an angle to the horizontal, no metal will remain in the spout after a pour has been made. Any metal remaining in the passageway would solidify to some extent, reducing the quality of subsequent pours.

The angle which the axis of rotation and the longitudinal axis of the spout passageway make with the horizontal is not too critical, other than if the angle is too shallow, the capacity of the chamber 18 may become too small, since the entire chamber volume occupied by molten metal must lie below the spout passageway 32 when the pouring ladle is in its full, nonpour position. The axis of rotation may form an angle X of between 20°–60° with the horizontal, with 30 –50° being the ideal for a ladle capable of holding a 200 –300 pound charge of molten metal.

Figure 5:
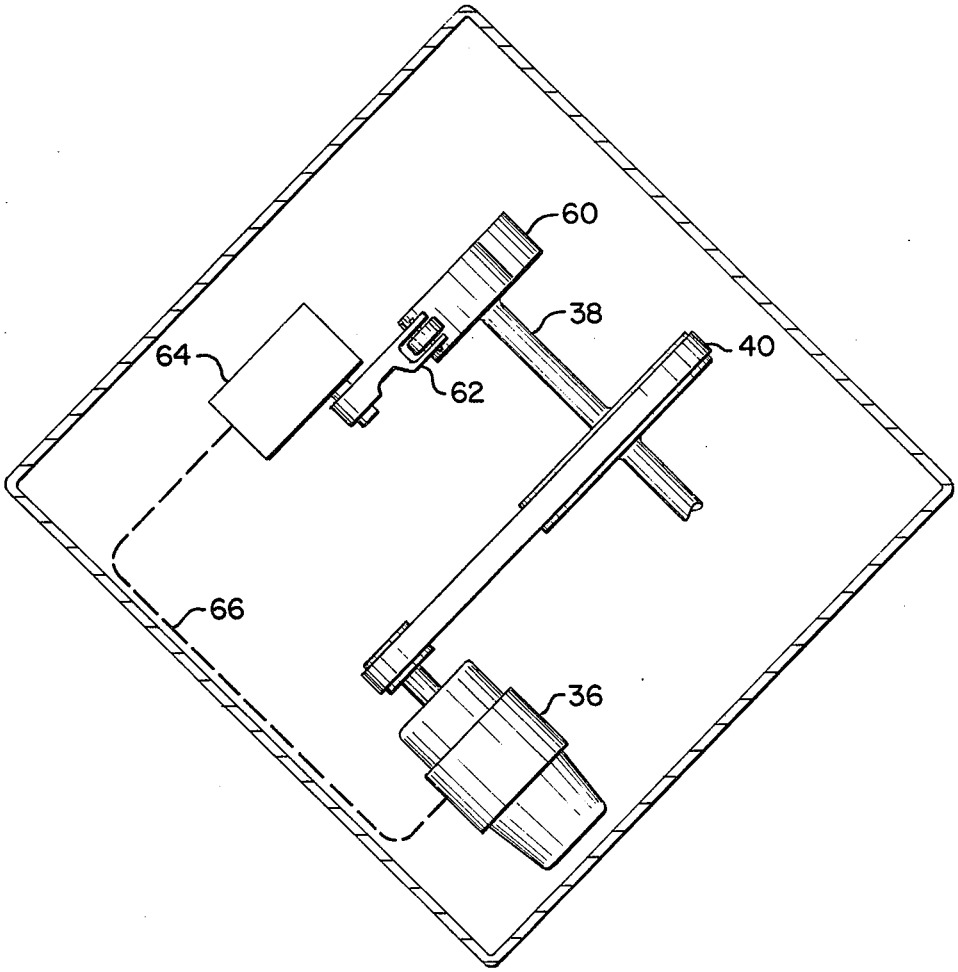
FIG. 5 is a sectional view taken on line 5—5 of FIG. 2.

FIG. 5 shows a control arrangement which will permit the tilting speed to be varied during a single pour; i.e., fast rotational speed for the first 30° of rotation, with a slower speed for the rest. As shown, a cam 60 is attached to the shaft 38. This cam 60 turns in the same angular rotation as the ladle. Rotation of the cam profile is used to depress a follower roller 62, which is attached to a control transmitter 64. The control transmitter 64 is connected to motor 36 through member 66 in such a manner that it controls the motor speed. The cam and transmitter combination provide a means to control pouring rate from the ladle which is desirable.

What is claimed is:

1. A pouring ladle for pouring molten metal into molds or other containers, including wall means forming a chamber for holding the molten metal, a spout having wall means forming longitudinal passage means therein, the passage means having an inlet end in fluid communication with the chamber, and an outlet end through which molten metal can be discharged, means for rotating the pouring ladle about an axis of rotation, positioned such that the axis of rotation passes through the center of the discharge end of the passage means, and the pouring ladle and spout being constructed such that lower outer surface of the wall means forming the chamber and the lower outer surface of the wall means of the spout lie in the same horizontal plane when the ladle is in its full, non-pouring position.

2. The pouring ladle set forth in claim 1, where the axis of the longitudinal passage means lies at an angle to the horizontal.

3. The pouring ladle set forth in claim 2, where the axis of rotation coincides with the axis of the longitudinal passage means.

4. The pouring ladle set forth in claim 3, where the axis of rotation makes an angle of approximately 20°–60° to the horizontal.

5. The pouring ladle set forth in claim 1, where the chamber is completely enclosed by the wall means, there only being an opening through the upper wall through which molten metal can be admitted thereto, and the passage means through which molten metal can be discharged therefrom.

6. The pouring ladle set forth in claim 5, wherein the ladle is further mounted on a vertical axis, so that it can be rotated about a vertical axis, so that the ladle can be swung out over a mold which is to be poured, and the pour can be made at any sprue opening location on the upper surface of the mold.

* * * * *